US005930565A

United States Patent [19]

Doi et al.

[11] Patent Number: 5,930,565

[45] Date of Patent: Jul. 27, 1999

[54] IMAGE FORMING APPARATUS

[75] Inventors: Isao Doi, Toyonaka; Keiko Momotani, Suita; Akihito Ikegawa, Sakai, all of Japan

[73] Assignee: Minolta Co., Ltd., Osaka, Japan

[21] Appl. No.: 09/061,266

[22] Filed: Apr. 17, 1998

[30] Foreign Application Priority Data

| | | | |
|---|---|---|---|
| Apr. 18, 1997 | [JP] | Japan | 9-101541 |
| Apr. 30, 1997 | [JP] | Japan | 9-112337 |
| Apr. 30, 1997 | [JP] | Japan | 9-112347 |

[51] Int. Cl.[6] ..... G03G 15/00; G03G 15/04

[52] U.S. Cl. ..... 399/159; 399/162; 430/60

[58] Field of Search ..... 399/159, 161, 399/162, 167, 154, 136, 135; 430/20, 48, 53, 60, 62, 66, 67, 68

[56] References Cited

U.S. PATENT DOCUMENTS

| | | | |
|---|---|---|---|
| 5,213,922 | 5/1993 | Matsuo et al. | 430/48 |
| 5,450,168 | 9/1995 | Utsumi et al. | 399/159 |
| 5,683,838 | 11/1997 | Iijima et al. | 430/20 |
| 5,815,774 | 9/1998 | Funayama et al. | 399/159 |

FOREIGN PATENT DOCUMENTS 1-293358 11/1989 Japan .

*Primary Examiner*—Arthur T. Grimley
*Assistant Examiner*—Hoan Tran
*Attorney, Agent, or Firm*—McDermott, Will & Emery

[57] ABSTRACT

An image forming apparatus includes a first conductive member, a photoelectric transfer layer mounted on the first conductive member, a surface electrode mounted adjacent to the photoelectric transfer layer but away from the first conductive layer, a dielectric layer opposed to the surface electrode, a second conductive member mounted on one surface of the dielectric layer away from the photoelectric transfer layer. A first power supply is provided for applying a voltage $V_c$ between first and second conductive members and a second power supply is provided for applying a voltage $V_b$ between the surface electrode and the second conductive member. The image forming apparatus satisfies following relationship:

$$V_b > (5.5)V_c - (1+5.5/D_p)(312+6.2D_a)$$

wherein $V_b$: Voltage between surface electrode and second conductive member;

$V_c$: Voltage between first and second conductive members;

$D_p$: Thickness of photoelectric transfer layer; and $D_a$: Distance between dielectric layer and photoelectric transfer layer.

22 Claims, 9 Drawing Sheets

| Ep | Image Extension |
|---|---|
| 53 | 1.2 |
| 53 | 1.6 |
| 53 | 1.7 |
| 64 | 0.6 |
| 64 | 0.6 |
| 64 | 0.6 |
| 75 | 0 |
| 75 | 0 |
| 75 | 0.05 |
| 86 | 0 |

IMAGE FORMING APPARATUS

RELATED APPLICATIONS

This application is based on Japanese Patent Applications Nos. 9-101541, 9-112337 and 9-112347, each content of which being incorporated herein by reference.

FIELD OF THE INVENTION

The present invention relates to an image forming apparatus such as printer and copy machine.

BACKGROUND OF THE INVENTION

Typically, conventional image forming devices including printer and copy machine employ a well-known electrophotographic image forming process. In this image forming process, an image bearing member such as photosensitive drum is electrically charged by a charger. The charged surface of the image bearing member is then exposed to a light, forming an electrostatic latent image. The electrostatic latent image is developed into a visual image which is then transferred onto a sheet such as plain paper.

Among the most common charger used for image forming devices in the art is a corona charger. The corona charger, however, generates a great deal of ozone, leading to a serious environmental disruption and providing an adverse affect for the photosensitive member to reduce duration thereof. For this reason, an alternative image forming process has been expected for years.

To counter this, Japanese Patent Laid-Open Publication No. 1-293358A discloses an image forming device capable of preventing the ozone from being produced. The device, which is illustrated in FIG. 7, includes a photosensitive member generally indicated by reference numeral 101 and an electric-charge bearing member generally indicated by reference numeral 102. The photosensitive member 101 has three layers; a support layer 103, an electrode layer 104 and a photosensitive layer 105, layered in this order. The bearing member 102 has a cylindrical support member 106 mounted for rotation, an electrode layer 107 coated on a periphery surface of the support member 106 and a dielectric layer 108 coated on an entire surface of the electrode layer 107. The photosensitive member 101 and the bearing member 102 are disposed so that the photosensitive layer 105 confronts to the dielectric layer 108 with leaving a small gap therebetween. Also, the photosensitive-member 101 is disposed in a dark.

In operation, a certain voltage is applied between the electrode layers 104 and 107. A light is projected on the photosensitive member 101 in the dark so that it scans in a direction parallel to an axis of the cylindrical bearing member 102. This provides an exposed portion of the photosensitive layer 105 with an electric charge. The electric charge is then discharged to an opposing portion of the dielectric layer 108, forming an electrostatic latent image in the dielectric layer 108. The latent image is then transported by the rotation of the support member 106 into a developing station where it is developed by a developer 109 into a toner image. The toner image is then transported to a transfer station where it is transferred onto a sheet such as paper or film.

The image forming device can certainly prevent the ozone from being produced, though, it has another problems. For example, when reproducing a line image extended in a rotational direction of the cylindrical support member 106 as shown in FIG. 8A, the corresponding latent image formed on the bearing member 102 is unnecessarily extended at a tailing edge thereof as shown in FIG. 8B in which a length of the extended portion is indicated by ΔL. The length of the extended portion increases in proportion to the length of the line image with respect to the rotational direction.

Tests were conducted to determine the causes of the extension. As a result, it was found that the extension might be caused by a residual electric charge or excessive carrier remaining in the photosensitive layer 105 that is continued to be discharged to the dielectric layer 108 even after the completion of the exposure. In the following description, the term "excessive carrier" will be used to mean a carrier or electric charge that is produced at the exposure in the exposed member and moves so slowly so that it is not discharged therefrom.

SUMMARY OF THE INVENTION

An image forming apparatus of the present invention includes a first conductive member, a photoelectric transfer layer mounted on the first conductive member, a surface electrode mounted adjacent to the photoelectric transfer layer but away from the first conductive layer, a dielectric layer opposed to the surface electrode, a second conductive member mounted on one surface of the dielectric layer away from the photoelectric transfer layer. A first power supply is provided for applying a voltage $V_c$ between first and second conductive members and a second power supply is provided for applying a voltage $V_b$ between the surface electrode and the second conductive member. The image forming apparatus satisfies following relationship:

$$V_b>(5.5)V_c-(1+5.5/D_p)(312+6.2D_a)$$

wherein $V_b$: Voltage between surface electrode and second conductive member;

$V_c$: Voltage between first and second conductive members;

$D_p$: Thickness of photoelectric transfer layer; and $D_a$: Distance between dielectric layer and photoelectric transfer layer.

Further, the image forming apparatus includes an exposing device which exposes the photoelectric transfer layer, generating an electric discharge between the photoelectric transfer layer and the dielectric layer, which results in an electrostatic latent image on the dielectric layer.

In another aspect of the present invention, the following equations are satisfied:

$$L<2D_a+2D_i(D_a+50)/(\epsilon_i D_a)-V_b/3.1V_c-V_b>3.1L+7.5D_p+312$$

wherein $V_b$: Voltage between surface electrode and second conductive member;

$V_c$: Voltage between first and second conductive members;

$D_i$: Thickness of dielectric layer;

$D_a$: Distance between dielectric layer and photoelectric transfer layer; and $\epsilon_I$: Dielectric component of dielectric layer.

In another aspect of the present invention, the surface electrode has a small conductive portion having a width W of 20 $\mu$m or less.

Accordingly, the image forming device will provide a number of advantages over the prior art electrophotographic image forming devices.

For example, the image forming device of the invention requires no charging device.

Also, a photosensitive member in the form of plate can be employed instead of conventional photosensitive drum.

Further, the photosensitive member of the invention functions only as a photoelectric transfer device and then is not subject to a mechanical stress that the conventional photosensitive drum would be provided by the contacts with a blade and toner particles, providing a photosensitive member free from deterioration such as thinning. This also ensures a long use of the photosensitive member.

Furthermore, the image is formed on the belt-like or drum-like dielectric member, permitting the use of a simultaneous transfer and fuse system, which increases a transfer efficiency and eliminates a cleaning unit.

Moreover, the present invention will provide an inexpensive and small-sized image forming device capable of forming a high quality image.

PREFERRED EMBODIMENT OF THE INVENTION

Figure 1:
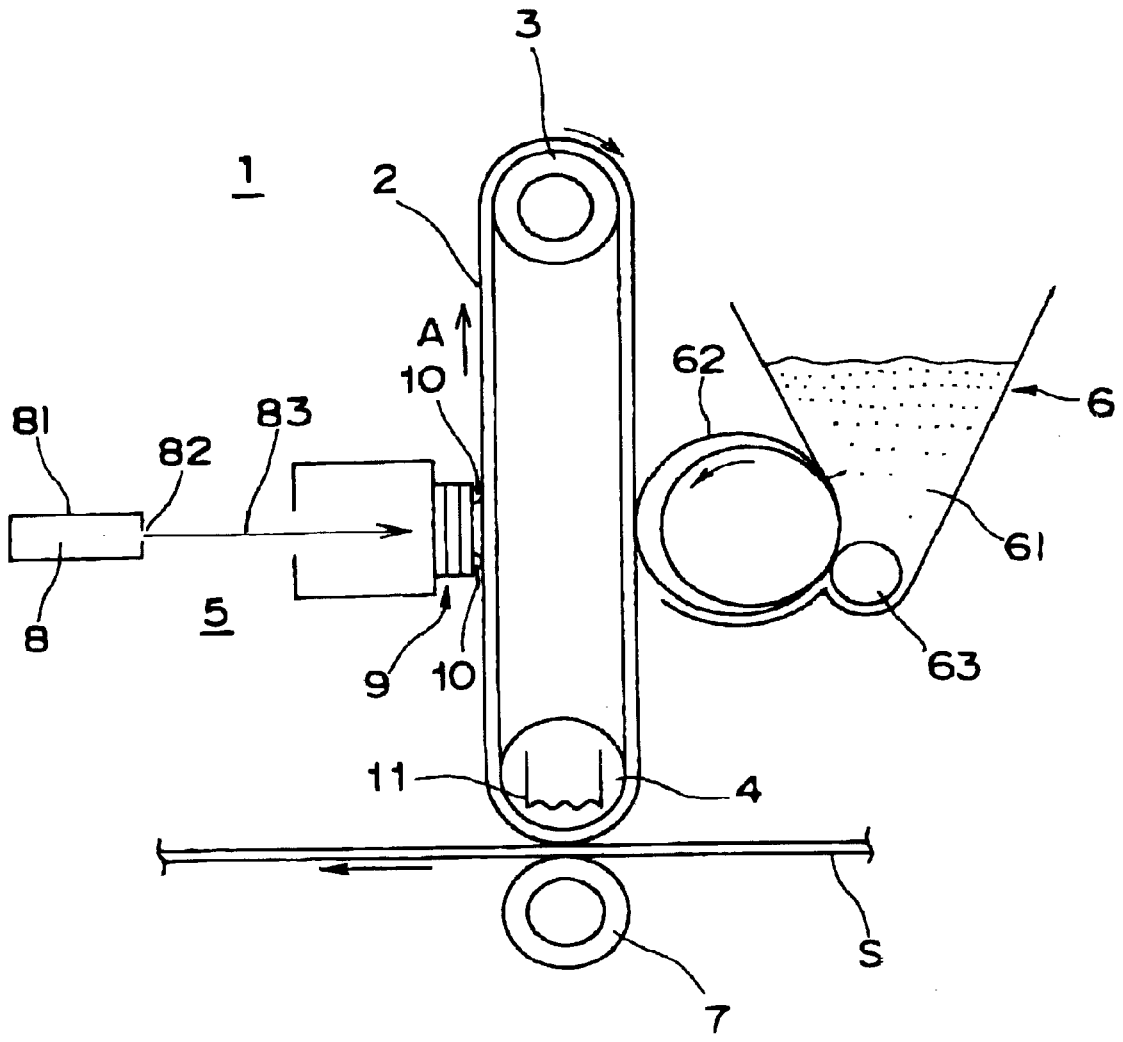
FIG. 1 is a schematic side elevational view of the image forming device of the present invention.

With reference to the drawings, in particular FIG. 1, an image forming device generally indicated by reference numeral 1 includes an endless image bearing member or belt 2. The image bearing belt 2 is entrained about a pair of parallel rollers, i.e., drive roller 3 and heat roller 4. The drive roller 3 is drivingly connected with a drive motor not shown so that it can rotate in a direction indicated at A.

Figure 2:
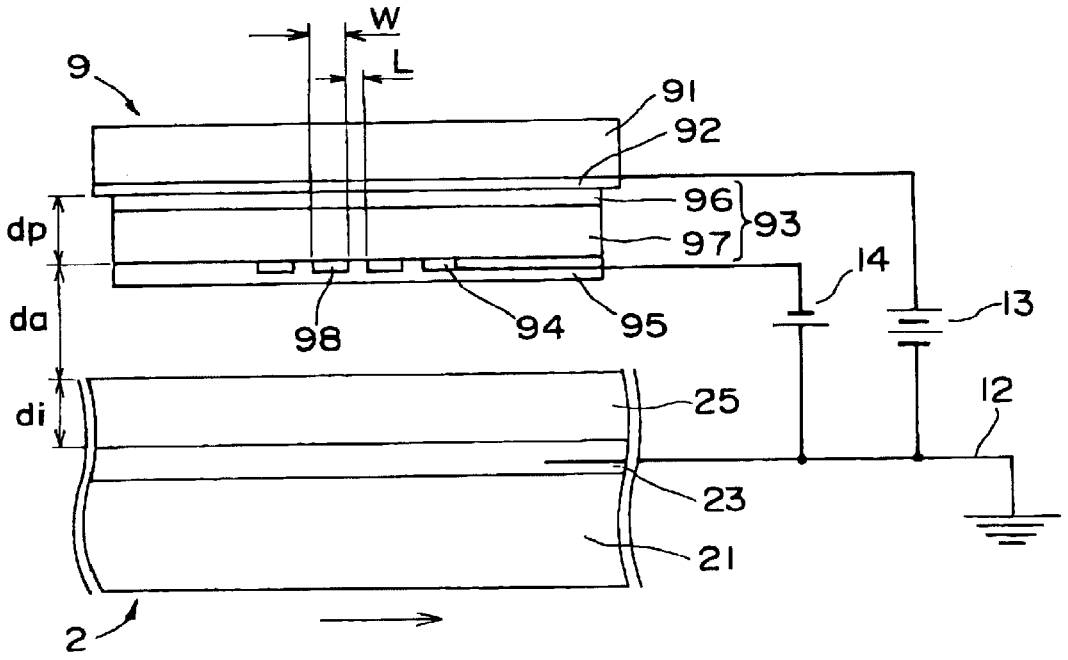
FIG. 2 is an enlarged partial view of a photosensitive member and an image bearing member.

As shown in FIG. 2, the image bearing member 2 includes an endless base belt 21, an electrically conductive layer 23 covering an outer periphery of the base belt 21 and a dielectric layer 25 mounted the conductive layer 23. For example, the base belt 21 is preferably made from an endless film of resin such as polyimide having a thickness of about 50 micronmeters and a width of about 25 centimeters. The conductive layer 23 is applied on the outer periphery of the base belt 21. The dielectric layer 25, preferably having a thickness of several micronmeters, is formed of resin such as fluorine resin and is grounded through a conductive wire 12. Although the endless belt is employed for the image bearing member 2, a drum-like image bearing member may be employed instead.

Referring again to FIG. 1, a latent image forming device generally indicated by reference numeral 5, a developing device 6 and a transfer roller 7 are arranged in this order around the image bearing belt 2 along the rotational direction A of the image bearing belt 2.

The latent image forming device 5 has an optical system 8 and a photosensitive member, generally indicated by reference numeral 9, made of photoelectric transfer elements which is disposed between the optical system 8 and the image bearing member 2. The optical system 8 has a housing 81 which includes a semiconductor laser generator, a collimator lens, a polygon mirror, F θ-lens, reflective mirrors and so forth. Also, the housing has 81 an exposure slot 82. Thus, a laser beam generated in the semiconductor laser generator is guided by the collimator lens, polygon mirror, F θ-lens and reflective mirrors and then emitted through the exposure slot 82. The emitted laser beam 83 is scanned to illuminate the photosensitive member 9, forming an electrostatic latent image therein. Preferably, the optical system has a resolution of about 300 dpi.

Note that the laser beam 83 scans in a transverse direction of the image bearing belt 2 which will be referred to as scanning direction in this description, as necessary. On the other hand, a direction along which the image bearing member travels is referred to as a transport direction.

As shown in FIG. 2, the photosensitive member 9 includes a light-transmittable base plate 91. The base plate 91 supports a light transmittable conductive layer 92 and a photosensitive layer 93, i.e., photoelectric transfer layer, of photoelectric transfer material mounted on the light transmittable conductive layer 92. On the photosensitive layer 93, a surface electrode layer 94 is patterned which will be described later. The electrode layer 94 is covered with a surface protection layer 95. Preferably, the light-transmittable base plate 91 is made from a transparent glass plate while the light-transmittable conductive layer 92 is made from an ITO film. The conductive layer 92 is electrically connected with a first power supply 13. Preferably, the photosensitive layer 93 is a function-separated type photosensitive member and thereby having a significant sensitivity to a long-wave light such as semiconductor laser light (having a wavelength of 780 nanometer) and LED light (having a wavelength of 680 nanometer). The photosensitive layer 93 includes a charge generating layer (CGL) 96 for generating carriers and a charge transporting layer (CTL) 97 capable of transporting free carriers. Preferably, a thickness of the photosensitive layer 93 is equal to or more than 5 micronmeters and equal to or less than 20 micronmeters. If the thickness is less than 5 micronmeters, an insulation of the photosensitive layer may be broken. On the other hand, if the thickness is more than 20 micronmeters, a moving speed of the electric charge may be delayed.

Figure 3:
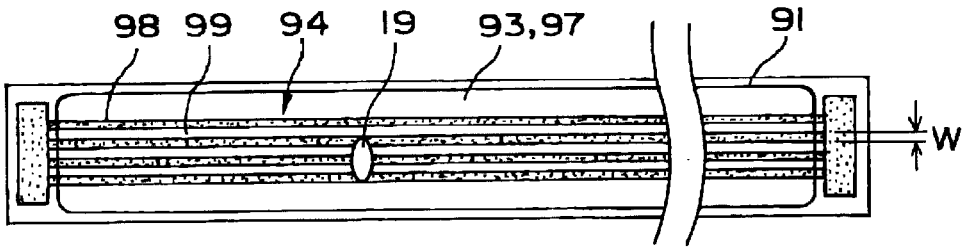
FIG. 3 is an enlarged plan view of the photosensitive member having four strip-like electrodes.

As best shown in FIG. 3, the surface electrode layer 94 includes four strip-like electrodes 98 arranged parallel to each other in the scanning direction, forming three slots 99.

Preferably, a width W of each electrode 98 is equal to or more than two micronmeters and equal to or less than 20 micronmeters. Also, preferably, a width L of the slot 99 is equal to or more than 15 micronmeters and equal to or less than 150 micronmeters. If the width W and L are less than respective lower limits, an electric discharge may occur between the neighboring electrodes. Also, if the width W and L are more than respective upper limits, a necessary electric discharge for forming an electrostatic latent image may not occur.

Advantageously, the surface protection layer 95 is an amorphous carbon film having a thickness of 0.15 micronmeters, formed by a plasma polymerization of 1,3—$C_4H_6$. The protection layer 95 may be eliminated from the photosensitive member 9. Preferably and advantageously, an insulative surface protection layer 95 is disposed on the surface electrode layer 94 to prevent the surface electrode layer 94 from being exposed to an electric discharge and to avoid an unexpected electric local discharge.

Referring again to FIG. 1, a spacer 10 is provided between the photosensitive member 9 and image bearing belt 2 so that the surface electrode 94 of the photosensitive member 9 confronts to the dielectric layer 25 of image bearing member 2 through an air gap $d_a$. This prevents foreign particles transported by the image bearing member from being transferred onto the photosensitive member 9, ensuring a stable formation of the electrostatic latent image in the photosensitive member 9. In this embodiment, although a fluorine resin is used for the spacer, it is not limited thereto. For example, any material having a low coefficient of friction and unlikely to damage the image bearing belt 2 can be used instead. Preferably, the air gap da is equal to or more than 5 micronmeters and equal to or more less than 100 (more preferably equal to or 30 micronmeters.) If the air gap is less than 5 micronmeters, an unnecessary electric discharge may occur between the photosensitive layer 25 and dielectric layer 25. Also, if the air gap is more than 100 micronmeters, a necessary discharge voltage for discharge will be increased to much, possibly breaking the insulation of the photosensitive layer and so forth.

The developing device 6 has a toner container 61 for receiving one component developer consisting of toner particles, a developing sleeve 62 disposed adjacent to the image bearing member 2 and a supply roller 63 for mixing the toner in the toner container 61 and then supplying the mixed toner to the developing sleeve 62. The toner used in this developing device is capable of being negatively charged and has an average particle size of about 10 micronmeters. Preferably, the toner is obtained from a mixture composed mainly of thermoplastic resin, for example, bisphenol A polyester resin and carbon black. As is well-known in the art, the mixture is kneaded, dried, finely broken and classified. The developing sleeve 62 is electrically connected with a power supply so that it can be biased to a certain voltage, preventing an unnecessary toner deposition onto the photosensitive drum.

The transfer roller 7 is arranged to make a circumferential contact with a portion of the image bearing belt 2 supported around the heat roller 4, forming a transfer station. A recording sheet or paper S is designed to be transported into the nipping region of between the transfer roller 7 and image bearing member 2.

A process for forming the electrostatic latent image bearing in the image forming device 1 will be described. A voltage $V_c$ of, for example, about +1,600 volts is applied from the first power supply 13 to the light transmittable conductive layer 92 of photosensitive member 9 while a voltage $V_b$ of, for example, about −100 volts is biased from the second power supply 14 to the surface electrode layer 94. This forms an electric field having a voltage difference of 1,600 volts between the grounded conductive layer 23 of the image bearing belt 2 and the light transmittable conductive layer 92 and an electric field having a voltage difference of 1,700 volts between the surface electrode layer 94 and the light transmittable conductive layer 92.

It should be noted than an absolute value of the voltage $V_c$ should be equal to or more than 500 volts and equal to or less than 3,000 volts. If the voltage $V_c$ is less than 500 volts, a uniform discharge may not be obtained. Also, if the voltage $V_c$ is more than 3,000 volts, an insulation breaking may be occurred in the photosensitive layer and so forth.

On the other hand, an absolute value of the voltage $V_b$ should be equal to or more than zero volt and equal to or less than 500 volts. If the voltage $V_b$ is more than 500 volts, a uniform discharge may not be obtained.

The laser beam 83 is then emitted from the optical system 8 onto the photosensitive member 9. The laser beam 83 travels through the light transmittable base plate 91 and conductive layer 92 and then reaches the electric charge generating layer 96. Upon receiving the laser beam 83, the electric charge generating layer 96 generates carriers under the existence of the electric field. Some carriers capable of moving freely advance in certain directions due to the electric field. Specifically, the free carriers positively charged move through the electric charge transporting layer 97 to the surface of the photosensitive layer 93. This increases the electric field in the space between the surfaces of the photosensitive layer 93 and image bearing belt 2. When the voltage of the increased electric field exceeds a threshold voltage determined by the Paschen's law, an electric discharge occurs between the photosensitive layer 93 and image bearing belt 2. The electric discharge transports the carrier, i.e., electric charge, which causes the surface of the dielectric layer 25 of the image bearing member 2 to be charged, forming an electrostatic latent image thereon.

The width of the strip-like electrodes 98 provides a significant effect to the formation of the electrostatic latent image. Specifically, the greater width of the electrode 98 tends to prevent electric lines of force from extending below the electrodes 98. This in turn prevents portions of the dielectric layer 25 corresponding to the electrodes 98 from being charged, causing defects in the electrostatic latent image, which in turn forms image defects in a resultant image.

To counter this, the width of each electrode 98 is set to be equal to or less than 20 micronmeters, which allows the electric lines of force to extend around the electrodes toward the portions of dielectric layer 98 right below the electrodes 98. This ensures the electric charge to be transported to such portions of the dielectric layer 98, charging the same. This in turn ensures to produce the electrostatic latent image and resultant image without any defects.

It should be noted that the photosensitive member 93 generates excessive carriers. The excessive carriers includes carriers held in traps formed adjacent to a border of between electric charge generating layer 96 and electric charge transporting layer 97 and carriers that move very slowly in the photosensitive layer 93. Disadvantageously, the excessive carriers can provide less exposure, resulting in a space electric-charge in the photosensitive layer 93 if the electric field in the photosensitive layer 93 is weak. This provides an adverse affect on the electrostatic latent image right after the exposure, tending to cause an unwanted extension at a tailing edge of resultant line image.

In this embodiment, however, the surface electrodes 94 retain a higher electric field in the photosensitive layer 93. This allows the excessive carriers to move immediately to the surface of the photosensitive layer 93 and then discharged or trapped in the surface electrodes 94, ensuring that no excessive carrier will be held in the photosensitive layer 93 after the completion of the exposure. As a result, no electric charge is discharged from the photosensitive layer to the dielectric layer after the completion of exposure, preventing the extension of the line image.

In view of this, due to the existence of surface electrodes 94, the electric discharge completes simultaneously with the completion of the exposure, ensuring the formation of the image having a good correspondence to the exposed image.

The electrostatic latent image formed on the image bearing member 2 is transported to a developing station by the rotation of the drive roller 3, where it is developed into a toner powder image. The toner image is then transported with the movement of the image bearing member 2 to a heat-transfer station, where it is fused by a heater 11 mounted in the heat roller 4 and then fully transferred to the recording paper S.

Tests were conducted for the image forming device shown in FIGS. 1 and 2 to evaluate the elimination of the image defects. In this device, the electrode layer 94 was patterned as shown in FIG. 3. Thicknesses $d_p$ of the photosensitive layer 93, $d_a$ of the air gap of the opposing surfaces of photosensitive layer 93 and dielectric layer 25 and $d_i$ of dielectric layer 25 of the image bearing member 2 are 15 micronmeters, 25 micronmeters and 15 micronmeters, respectively. The voltage $V_c$ applied to the light transmittable conductive layer 92, voltage $V_p$ applied to the surface electrode 94, width L of the slot between neighboring electrodes and width W of the electrode employed in the tests are shown in Table 1. Table 1 also shows image qualities formed under respective conditions. In each test, line images each having four dots in the cross section thereof and extending in the transport direction were reproduced. A diameter of the dot was about 80 $\mu$m. The lines were viewed with microscope to find noises and density-unevenness and ranked as follows:

A: No noise or density-unevenness was found;

B: Only a few noises and density-unevenness were found;

C: A few noises and density-unevenness, not providing a problem for practical use, were found; and D: A number of noises and deisity-unevenness, leading a serious problem for practical use, were found.

TABLE 1

| Test No. | $V_c$ [volts] | $V_p$ [volts] | L [$\mu$m] | W [$\mu$m] | Image Quality |
|---|---|---|---|---|---|
| 1 | 1,600 | −100 | 50 | 8 | A |
| 2 | 1,600 | −100 | 50 | 10 | A |
| 3 | 1,600 | −100 | 50 | 15 | B |
| 4 | 1,600 | −100 | 50 | 20 | C |
| 5 | 1,600 | −100 | 50 | 30 | D |
| 6 | 1,700 | 0 | 70 | 10 | A |
| 7 | 1,700 | 0 | 70 | 15 | B |
| 8 | 1,700 | 0 | 70 | 20 | C |
| 9 | 1,700 | 0 | 70 | 30 | D |
| 10 | 1,700 | 0 | 70 | 40 | D |
| 11 | 1,800 | 0 | 100 | 10 | A |
| 12 | 1,800 | 0 | 100 | 15 | B |
| 13 | 1,800 | 0 | 100 | 20 | C |
| 14 | 1,800 | 0 | 100 | 25 | D |
| 15 | 1,800 | 0 | 100 | 30 | D |

TABLE 1-continued

| Test No. | $V_c$ [volts] | $V_p$ [volts] | L [$\mu$m] | W [$\mu$m] | Image Quality |
|---|---|---|---|---|---|
| 16 | 1,800 | 0 | 100 | 50 | D |

This result indicates that, if the width W of the electrode 98 of the surface electrode layer 94 is more than 20 micronmeters or more, the noises and density-unevenness due to the defects of electrostatic latent image increase, causing a practical problem. Accordingly, the width W of the electrode 98 should be equal to or less than 20 micronmeters.

Figure 4:
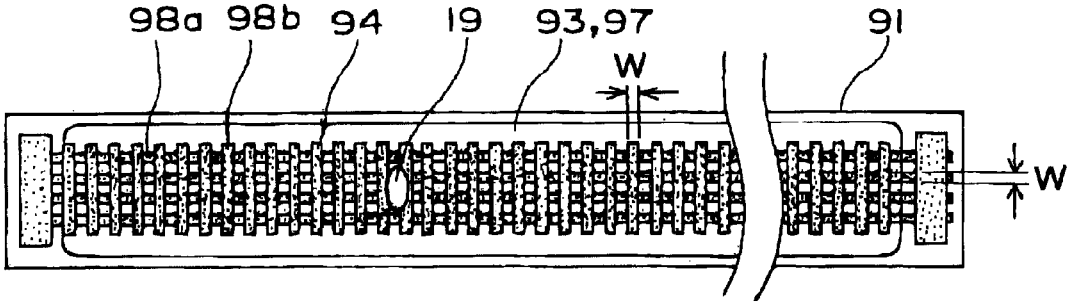
FIG. 4 is an enlarged plan view of the photosensitive member of another embodiment having electrodes arranged in lattice.
Figure 5:
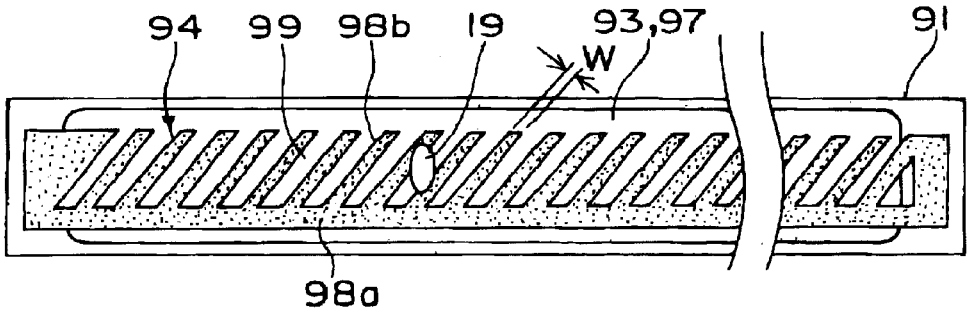
FIG. 5 is an enlarged plan view of the photosensitive member of another embodiment having slanted small electrodes.
Figure 6:
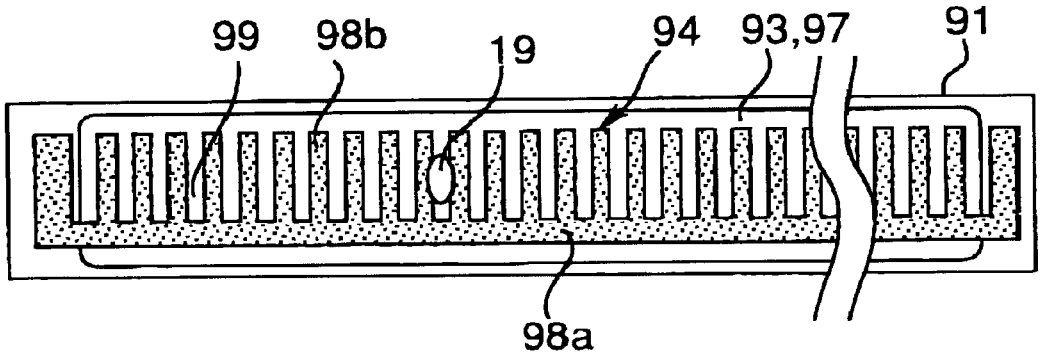
FIG. 6 is an enlarged plan view of the photosensitive member of another embodiment having small electrode.
Figure 7:
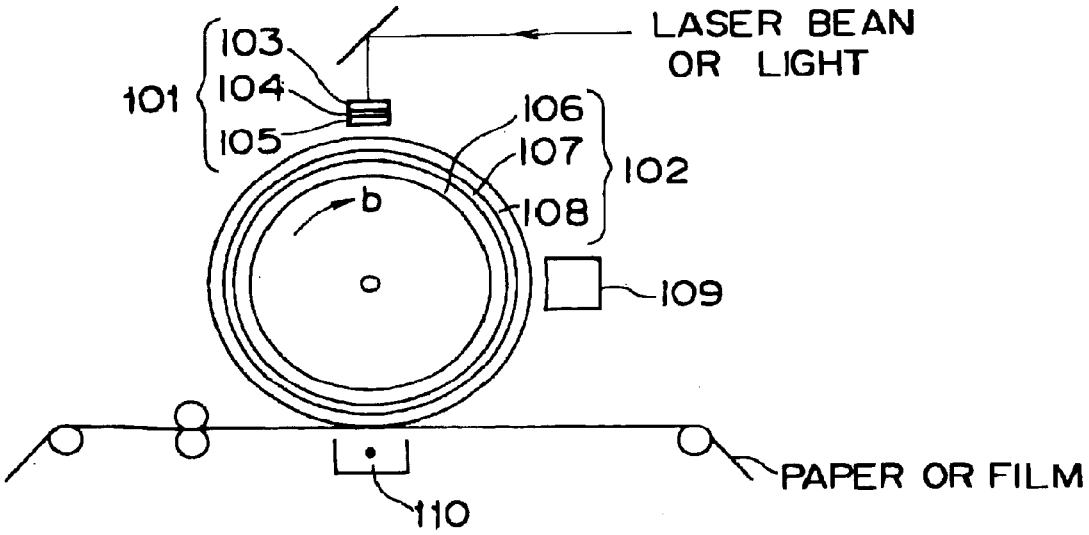
Fig. 7 PRIOR ART
FIG. 7 is a schematic side elevational view of a conventional image forming device.

FIGS. 4 to 6 show other arrangements of the surface electrode 94. In each drawing, a reference numeral 19 indicates a laser spot exposed. The arrangement shown in FIG. 4 has four strip-like electrodes 98*a* extended in the transverse direction and a number of short electrodes 98*b* extended in the transport direction, forming a lattice. In this instance, widths of the electrodes 98*a* and 98*b* should be equal to or less than 20 micronmeters.

Another arrangement shown in FIG. 5 has a strip-like electrode 98*a* extended in the transverse direction and a number of short electrodes 96*b* extended from and slanted to the electrode 98*a*. In this instance, the strip-like electrode 98*a* is spaced away from an exposed area and then provides no adverse affect on the image quality. Then, this arrangement requires that only the short electrodes 98*b* have a width W of equal to or less than 20 micronmeters.

Another arrangement shown in FIG. 6 has a strip like electrode 98*a* extended in the transverse direction and a number of short electrodes 98*b* extended perpendicular to the electrode 98*a*. In this instance, each of the short electrodes has a width W of equal to or less than 20 micronmeters.

These arrangements will eliminate the defects of the image and the extensions of the line images, which in turn ensuring the image forming device to reproduce images truly corresponding to original images.

Figure 8A:
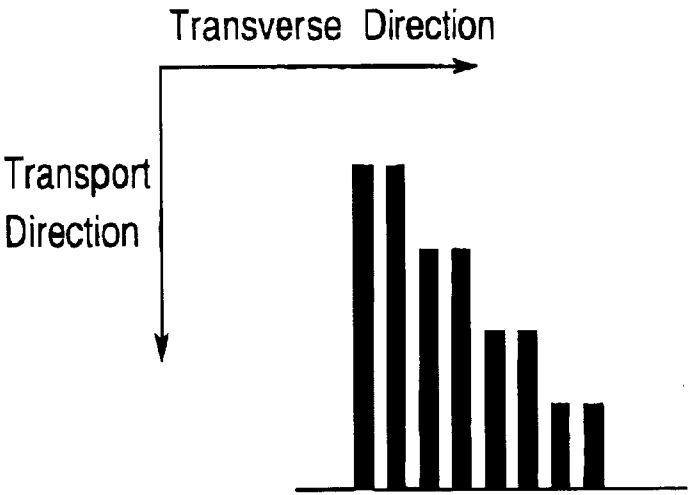
FIG. 8A is an original document having line images extending in a transverse direction.
Figure 8B:
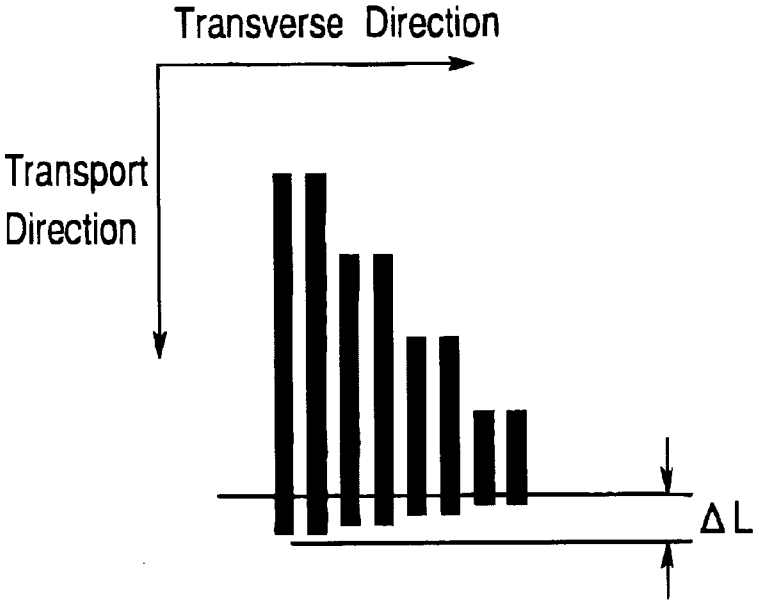
FIG. 8B is a reproduced image in which the line images are extended at tailing edges thereof.
Figure 9:
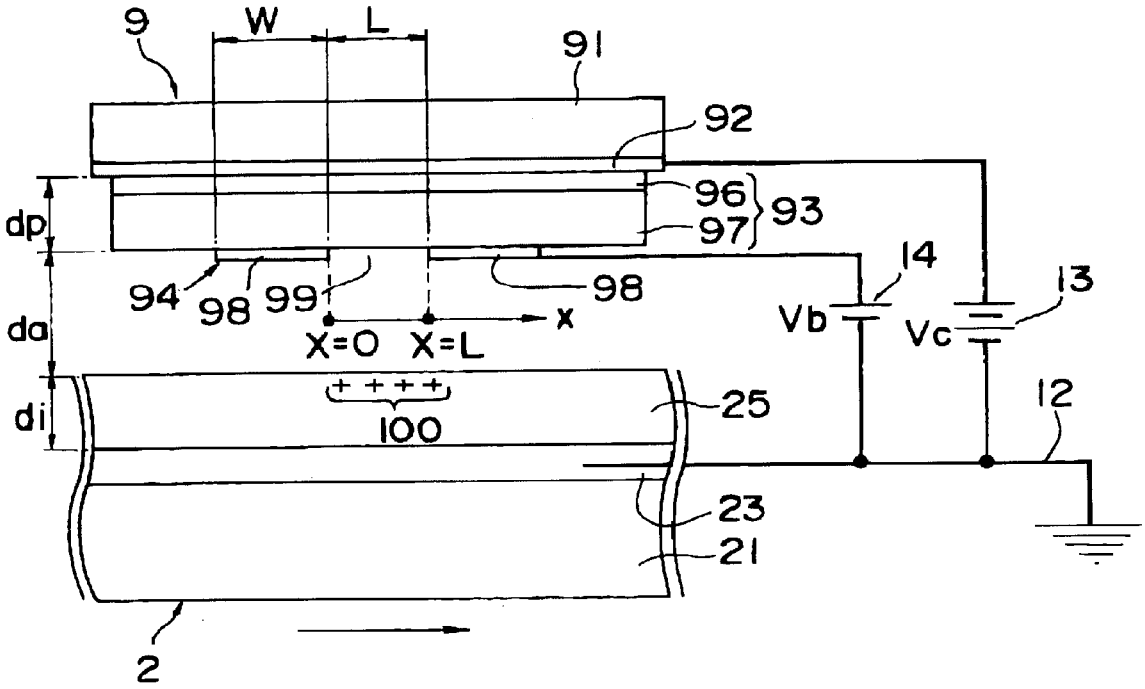
FIG. 9 is an enlarged side elevational view a photosensitive member and an image bearing member of another embodiment.

FIGS. 8 and 9 shows another embodiment of the surface electrode layer 94. The electrode layer 94 includes a pair of parallel electrodes 98 extended in the transverse direction and spaced away from each other to form a slot 99 having a width of L. Preferably, the slot-patterned surface electrode layer 94 is formed by a deposition of aluminum with a mask of pattern corresponding to the electrode layer 94 positioned on the photosensitive layer 93. The mask pattern is removed after deposition. To prevent an oxidation of the surface electrode layer 94 due to the electric discharge, the surface electrode layer 94 may be coated with an insulative protection layer.

A surface voltage of a portion of photosensitive layer 93 in the slot 99 spaced away a distance X (≦L) from one electrode 98 toward the other electrode 98 is indicated by $V_p(X)$. Note that $V_p(0)$ equals to $V_b$, i.e., the voltage biased to the surface electrode 94. A threshold voltage $V_{thy}(X)$ that occurs a lateral discharge between one electrode 98 and a portion of the photosensitive layer 93 in the slot spaced away a distance X from the one electrode 98 at an atmospheric pressure is given from a proximate equation of the Paschen's law as follows:

$$V_{thy}(X)=312+6.2X \quad (1)$$

Another threshold voltage $V_{thy}$ that occurs a vertical discharge between the photosensitive layer and dielectric layer 25 is given as follows:

$$V_{thy}=(312+6.2d_a)(1+d_i/(\epsilon_i d_a)) \quad (2)$$

wherein $d_a$: Thickness of an air gap between photosensitive layer 93 and dielectric layer 25;

$d_i$: Thickness of dielectric layer 25; and $\epsilon_i$: Dielectric constant.

A condition that the lateral discharge takes precedence over the vertical discharge at the surface portion of the photosensitive layer 93 spaced away a distance X from the edge of the electrode 98 of the surface electrode 94 requires that the surface voltage $V_p(X)$ is greater than the voltage $V_b$ biased to the surface electrode 94 by the threshold voltage $V_{thy}$ and smaller than the threshold voltage $V_{thT}$ as illustrated in the following equations (4) and (5):

$$V_p(X)=V_{thY}+V_b<V_{thT} \quad (3)$$

$$312+6.2X+V_b<(312+6.2d_a)(1+d_i/(\epsilon_i d_a)) \quad (4)$$

$$X<d_a+d_i(d_a+50)/(\epsilon_i d_a)-V_b/6.2 \quad (5)$$

In order that the lateral discharge takes precedence over the vertical discharge for the entire surface of the photosensitive layer 93 in the slot 99, the equation (5) should be satisfied at the mid portion of the opposing electrodes 98. That is, a following equation (6) that is obtained by substituting L/2 for X in equation (5) should be satisfied.

$$L<2d_a+2d_i(d+50)/(\epsilon_i d_a)-V_b/3.1 \quad (6)$$

The electric charge generated by the lateral discharge is transported toward the dielectric layer 25 due to the electric field formed between the conductive layer 25 of photosensitive layer 9 and the conductive layer 23 of image bearing member 92. This causes the surface of the dielectric layer 25 to be partially charged to form an electrostatic latent image corresponding to the exposed image. In view of this, the lateral discharge occurred under the condition that satisfies equation (6) provides the surface voltage of the photosensitive layer 93 with no adverse effect on the surface voltage of the opposing dielectric layer 25, keeping a constant force of electric field in the photosensitive layer 93.

Figure 10:
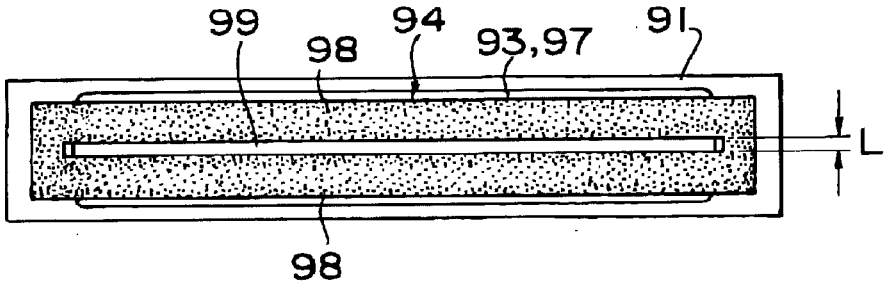
FIG. 10 is an enlarged plan view of the photosensitive member in FIG. 9.
Figure 11:
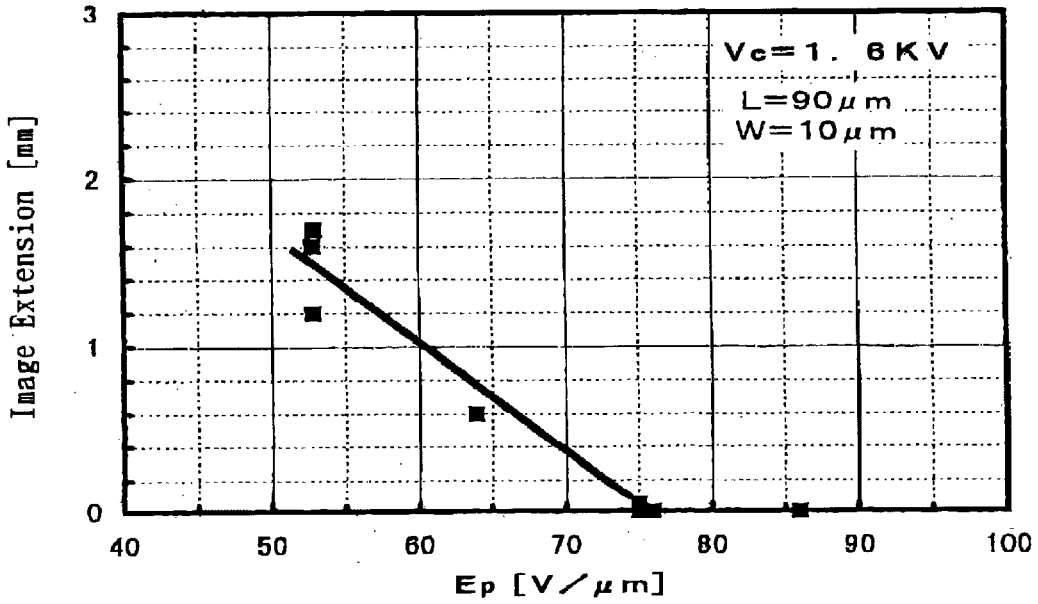
FIG. 11 is a graph showing a relationship between $E_p$ and image extension.

Tests conducted by the inventors show that the force of electric field in the photosensitive layer 93 should be kept more than a certain level for preventing the accumulation of the free carriers in the photosensitive layer 93 and thereby avoiding the generation of the excessive carrier. In test, the width L of the slot in the surface electrode 94 and the width W of the electrodes 98 of the surface electrode 94 were set to 90 micronmeters and 10 micronmeters, respectively. The voltage $V_c$ of 1,600 volts was applied to the conductive layer 92 of the photosensitive member 9. Another voltage $V_b$ applied to the surface electrode 94 was changed and the line image extension was observed for each voltages. FIG. 10 shows the test result in which the line extension decreases as the force of electric field increase. FIG. 10 also shows that the line extension can not be avoided if the force of electric field is less than about 75 volts per micronmeters.

Descriptions will be made to a condition that the force of electric field is greater than 75 volts per micronmeters at which the lateral discharge antecedes the vertical discharge. An intensity of electric field $E_p$ (X) at a portion in the photosensitive layer 93 spaced away a distance X from the electrode is expressed by the following equation (7):

$$E_p(X)=(V_c-V_p(X))/d_p \quad (7)$$

The equation (7) can be rewritten using equations (3) and (4) as follows:

$$E_p(X)=(V_c-312-6.2X-V_b)/d_p \quad (8)$$

Also, to prevent the line image extension in the area corresponding to slot 99, the intensity of the electric field $E_p(L/2)$ should be more than 75 volts per micronmeters at the central portion of the slot. Therefore, the equation (8) will be changed as follows:

$$E_p(L/2)=(V_c-312-6.2(L/2)-V_p)/d_p>75V_c-312-3.1L-V_b>75d_pV_c-V_b>3.1L+75d_p+312 \quad (9)$$

Thus, setting and operating image forming device of this embodiment to satisfy equations (6) and (9) will provide the lateral discharge between the photosensitive layer 93 and the surface electrode 94 with the priority over the vertical discharge. This keeps a constant higher level of intensity of electric field in the photosensitive layer 93 without any relationship with the surface voltage of the dielectric member and then prevents the accumulation of excessive carrier in the photosensitive layer 93. As a result, the free carriers generated in the photosensitive layer 93 will reach the surface of the photosensitive layer 93 and then discharge therefrom or will be captured in the surface electrode layer 94. This in turn simultaneously completes the exposure and discharge, forming an electrostatic latent image identical to the original image and having no image extension.

Although the descriptions has been made to the electrode pattern shown in FIG. 9, other electrode patterns illustrated in FIGS. 4 to 6 can be employed instead.

Another tests were made to confirm the elimination of the image extension using the image forming device equipped with the surface electrode pattern shown in FIG. 9. Test conditions and the results are shown in a table 2.

In this table 2, P* represents a value of right side of equation (9) and Q* represents a value of right side of equation (6) where the dielectric constant $\epsilon_i$ is 3.5. Highlighted values of P* and Q* indicate that both equations (6) and (9) are satisfied. In tests, lines having lengths from 10 to 40 millimeters, including four dots at any cross section, were reproduced and the lengths ΔL of extensions were measured. Also, the resultant images were ranked depending upon the length of the extension as follows:

A: $\Delta L \leqq 30\ \mu m$

B: $30\ \mu m<\Delta L \leqq 50\ \mu m$

C: $50\ \mu m<\Delta L \leqq 100\ \mu m$

B: $200\ \mu m \leqq \Delta L$

TABLE 2

| Test No. | L [μm] | $V_c$ [volts] | $V_p$ [volts] | $d_a$ [μm] | $d_p$ [μm] | $d_i$ [μm] | $V_c$–$V_b$ [volts] | P* | Q* | Image Quality |
|---|---|---|---|---|---|---|---|---|---|---|
| 1 | 50 | 1,600 | −100 | 20 | 15 | 15 | 1,700 | 1,592 | 102 | B |
| 2 | 50 | 1,600 | −100 | 30 | 15 | 15 | 1,700 | 1,592 | 115 | A |
| 3 | 50 | 1,600 | −100 | 50 | 15 | 15 | 1,700 | 1,592 | 149 | A |
| 4 | 50 | 1,600 | 0 | 20 | 13 | 15 | 1,600 | 1,442 | 70 | B |
| 5 | 50 | 1,600 | 0 | 30 | 13 | 15 | 1,600 | 1,442 | 83 | B |
| 6 | 50 | 1,600 | 0 | 50 | 13 | 10 | 1,600 | 1,442 | 111 | B |
| 7 | 50 | 1,600 | 50 | 20 | 15 | 10 | 1,550 | 1,592 | 44 | D |
| 8 | 50 | 1,600 | 100 | 20 | 15 | 15 | 1,500 | 1,592 | 38 | D |
| 9 | 50 | 1,600 | 100 | 30 | 15 | 10 | 1,500 | 1,592 | 43 | D |
| 10 | 50 | 1,600 | 100 | 50 | 15 | 15 | 1,500 | 1,592 | 85 | D |
| 11 | 70 | 1,600 | −100 | 20 | 15 | 10 | 1,700 | 1,654 | 92 | A |
| 12 | 70 | 1,600 | −100 | 20 | 15 | 10 | 1,700 | 1,654 | 92 | B |
| 13 | 70 | 1,600 | −100 | 30 | 15 | 10 | 1,700 | 1,654 | 107 | B |
| 14 | 70 | 1,600 | 0 | 20 | 15 | 15 | 1,600 | 1,654 | 70 | D |
| 15 | 70 | 1,600 | 0 | 20 | 15 | 10 | 1,600 | 1,654 | 60 | D |
| 16 | 70 | 1,700 | 0 | 30 | 15 | 15 | 1,700 | 1,654 | 83 | B |
| 17 | 70 | 1,700 | 0 | 30 | 15 | 10 | 1,700 | 1,654 | 75 | C |
| 18 | 100 | 1,800 | 0 | 30 | 15 | 10 | 1,800 | 1,747 | 75 | D |
| 19 | 100 | 1,800 | 0 | 50 | 15 | 15 | 1,800 | 1,747 | 117 | C |
| 20 | 100 | 1,800 | 0 | 50 | 15 | 10 | 1,800 | 1,747 | 111 | C |
| 21 | 100 | 1,800 | 100 | 30 | 15 | 15 | 1,700 | 1,747 | 51 | D |
| 22 | 100 | 1,800 | −100 | 50 | 15 | 15 | 1,900 | 1,747 | 149 | B |

As shown in the table 2, tests 1–6, 11–13, 16, 17, 20 and 22 satisfied both equations (6) and (9) and produced images having little line extension and suitable for practical use. Tests 10 and 14 satisfied only equation (6) while test 10 only satisfied only equation (9), providing large extensions not suitable for practical use. Tests 7–10 and 21 did not meet equation (6) or (9), resulting larger extensions.

As described above, by setting the width of slot in the patterned surface electrode layer and the voltage applied to the electrode layer to a certain range that meet the above-described conditions, the lateral discharge between the photoelectric transfer layer and surface electrode layer takes precedence over the vertical discharge without having no or little adverse affect from the surface voltage of the dielectric layer. This keeps a constant and higher level of electric field in the photoelectric transfer layer, which prevents the accumulation of the excessive carriers. Therefore, no discharge continues after the completion of exposure, eliminating the extension of the tailing edge of line image. This in turn ensures the resultant image to be thoroughly identical to the original image.

Figure 12A:
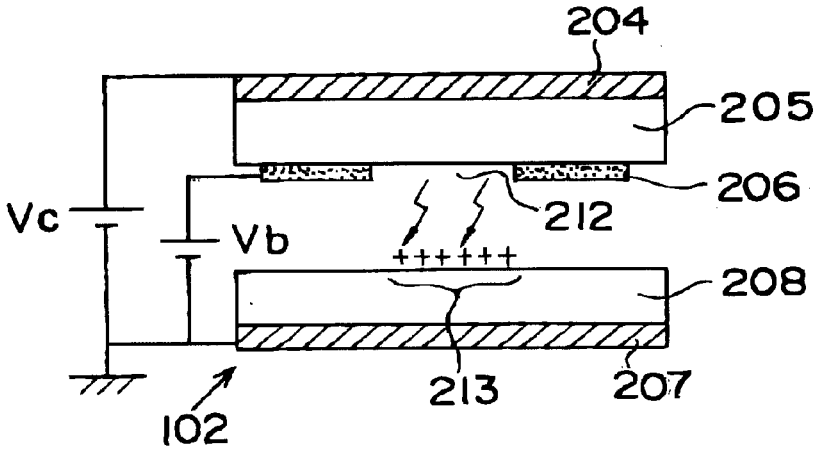
FIGS. 12A to 12C show a process of a reverse discharging.

Meanwhile, it should be noted that the patterned surface electrode layer including a slot could generate reverse discharge noises in the resultant image depending upon conditions of the electrodes. Specifically, as shown in FIG. 12A, when voltages $V_c$ and $V_b$ are applied to a photosensitive electrode 204 and surface electrode layers 211, respectively, and a electric charge bearing member 207 is grounded, an image exposure on the photosensitive layer 205 would allow free carriers generated in the photosensitive layer 205 to move toward to its surface. Some free carriers adjacent to the surface electrode layer 211 move into the electrode layer 211. Other free carriers away from the surface electrode layer 211 but adjacent to the slot 212 increase surface voltages thereof by an accumulation of the free carrier, generating an electric discharge between the surface electrode layer 211 and the photosensitive layer 205. The electric discharge provide an electric charge to a region 213 of an insulative layer 208 opposing to the slot 212 of the surface electrode layer 211, forming an electrostatic latent image thereon.

Figure 12B:
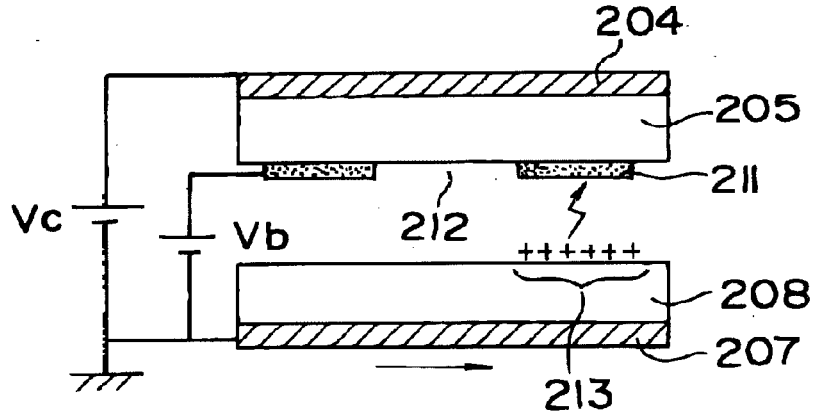
Figure 12C:
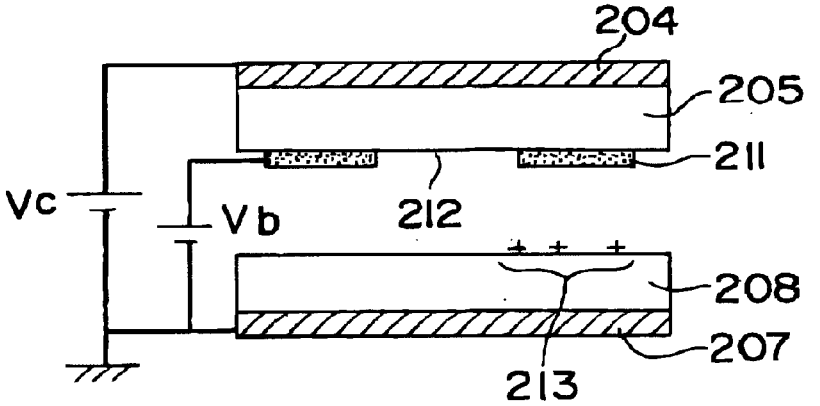

Subsequently, as shown in FIG. 12B, when the charged region 213 reaches an opposing portion due to the rotation of the electric charge bearing member 202, a reverse electric field against an electric field is generated by the voltage difference $V_c$ between the electrodes 204 and 207. If the voltage of the reverse electric field exceeds a voltage that occurs an electric discharge, the electric discharge occurs from the charged region 213 to the surface electrode layer 211, eliminating a part of the electric charge in the charged region as shown in FIG. 12C. The electric discharge occurs randomly, causing defects in the electrostatic latent image, which results in a density unevenness in an output image. This image noise caused by the reverse electric discharge is called a reverse discharge noise.

A following description relates to a technique for eliminating the reverse discharge noise. Specifically, to eliminate the reverse discharge noise, when the charged region of the dielectric layer confronts to the electrode of the surface electrode layer, a voltage difference between the charged region and the surface electrode layer should be less than a threshold voltage that occurs the electric discharge.

Referring again to FIGS. 9 and 10, conditions or equations for preventing the reverse discharge noise will be discussed. Assumed that the photosensitive layer 93 would be a highly conductive conductive material and then the surface voltage of the photosensitive layer 93 becomes to be equal to the voltage $V_c$ applied to conductive layer 92. In this instance, if the electric discharge would occur between the photosensitive layer 93 and dielectric layer 25, the voltage difference therebetween decreases to a threshold voltage or electric discharge initiating voltage $V_{th}$ that occurs the electric discharge. A theoretical voltage $V_0'$ of a charged region 100 can be expressed as a difference between the surface voltage $V_c$ of the photosensitive layer 93 and the electric discharge initiating voltage $V_{th}$ as follows:

$$V_0' = V_c - V_{th} \tag{10}$$

An actual voltage on the charged region 100 would be lower than the theoretical voltage $V_0'$. A voltage of the dielectric layer 25 was measured for an image forming device free from surface electrode layer. The measured charged voltages of the dielectric layer 25 had a tendency to decrease in reverse proportion to a thickness of the photosensitive layer 93. Then, the voltage $V_0$ of the charged region 100 can approximately be expressed by the following equation (11):

$$V_0 \approx (\alpha/d_p)(V_c - V_{th}) \quad (11)$$

wherein $\alpha$ is a coefficient that is equal to or less than $d_p$ because an actual voltage of the charge region 100 will never exceed the theoretical voltage.

When the charged region 100 of the dielectric layer 25 would reach a position where it confronts to the conductive portion 98 of the surface electrode 94, a voltage difference $V_a$ therebetween can be expressed as a voltage difference between the voltage of the charge region 100 and the voltage $V_b$ biased to the surface electrode 94 as follows:

$$V_a \approx V_0 - V_p \approx (\alpha/d_p)(V_c - V_{th}) - V_p \quad (12)$$

When the voltage $V_a$ exceeds the electric discharge initiating voltage $V_{th}$, i.e., $V_a > V_{th}$, the reverse discharge will occur. Then, a following equation (13) can be derived from the above equation (12).

$$[(\alpha/d_p)(V_c - V_{th}) - V_p] > V_{th} \quad (13)$$

The equation (13) can be rewritten as follows:

$$V_p < (\alpha/d_p)V_c - (1+\alpha/d_p)V_{th} \quad (14)$$

The surface electrode 94 has a very small thickness of, for example, about 0.1 micronmeters, which can be negligible. Then, the electric discharge initiating voltage $V_{th}$ between the surface electrode 94 and dielectric layer 25 can approximately be expressed using a distance $d_a$ therebetween according to the Patchen's law as follows:

$$V_{th} = 312 + 6.2d_p \quad (15)$$

A following equation (16) can be obtained from equations (14) and (15).

$$V_p < (\alpha/d_p)V_c - (1+\alpha/d_p)(312+6.2d_p) \quad (16)$$

From the equation (16) and conditions for initiating the reverse discharging derived from the tests to be described below, $\alpha$ was determined to 5.5 at which the theoretical value agreed substantially to the test result.

Therefore, to prevent the reverse discharge, the electrostatic latent image should be formed under the condition that meets the following equation (17).

$$V_p > (5.5/d_p)V_c - (1+5.5/d_p)(312+6.2d_p) \quad (17)$$

With the condition that meets equation (17), when the region 100 of dielectric layer 25 charged by the image exposure would enter a position where it confronts to the conductive portion 98 of the surface electrode 94 with the movement of the image bearing belt 2, the voltage difference $V_a$ between the charged region 100 and surface electrode 94 will not exceed the discharge initiating voltage $V_{th}$, preventing the reverse discharging. This in turn avoids the reverse discharge noises.

Also, the biased surface electrode layer 94 allows the free carriers generated in the photosensitive layer 93 due to the exposure to move instantly to the surface of the photosensitive layer 93 because the photosensitive layer constantly keeps a high electric field. This allows the free carriers to be discharged from a portion of the surface electrode layer 94 in the slot 99 toward the dielectric layer 25 or to be captured by the surface electrode layer 94. Therefore, the photosensitive layer retains no or few excessive carrier therein. This does not mean that excessive carriers would be discharged after exposure which, if otherwise, would cause the extension of the electrostatic latent image formed in the dielectric layer 25 of the image bearing member.

Tests were conducted in which the image bearing belt shown in FIG. 9 and the surface electrode layer 94 having the slot shown in FIG. 10 were used to produce images and the images were evaluated with respect to the noises by the reverse discharge.

In tests, the thickness $d_p$ of the photosensitive layer 93, distance $d_a$ between the photosensitive layer 93 and dielectric layer 25, voltage $V_c$ applied to the conductive layer 92 of the photosensitive member 9 and voltage $V_b$ applied to the surface electrode layer 94 were changed.

The results are shown in the following tables 3 to 5, in which Z* represents a value of the right side of equation (17). Also, in each test, a test pattern including line images extending in the transport direction and having four dots in the transverse direction was exposed by a laser beam. The noises due to reverse discharge were observed in the resultant image on a recording sheet and the images were evaluated as follows:

Rank A: No noise was observed.

Rank B: Some noises were observed.

Rank C: A number of noises were observed.

TABLE 3

| Test No. | $d_I$ (μm) | L (μm) | $d_p$ (μm) | $d_a$ (μm) | $V_c$ (V) | $V_b$ (V) | Z* | Noise |
|---|---|---|---|---|---|---|---|---|
| 1 | 14 | 80 | 18 | 20 | 1,400 | 0 | −141 | A |
| 2 | 14 | 80 | 18 | 20 | 1,600 | 0 | −80 | A |
| 3 | 14 | 80 | 18 | 20 | 1,800 | 0 | −19 | A |
| 4 | 14 | 80 | 18 | 20 | 2,000 | 0 | 42 | B |
| 5 | 14 | 80 | 18 | 20 | 2,200 | 0 | 103 | C |
| 6 | 14 | 80 | 18 | 30 | 1,800 | 0 | −100 | A |
| 7 | 14 | 80 | 18 | 10 | 1,800 | 0 | 62 | B |
| 8 | 14 | 80 | 18 | 20 | 1,600 | −200 | −80 | C |
| 9 | 14 | 80 | 18 | 20 | 1,800 | −200 | −19 | C |
| 10 | 14 | 80 | 18 | 20 | 1,600 | −100 | −80 | B |
| 11 | 14 | 80 | 18 | 20 | 1,800 | −100 | −19 | C |
| 12 | 14 | 80 | 18 | 20 | 1,600 | 100 | −80 | A |
| 13 | 14 | 80 | 18 | 20 | 1,800 | 100 | −19 | A |
| 14 | 14 | 80 | 18 | 20 | 2,000 | 100 | 42 | A |
| 15 | 14 | 80 | 10 | 20 | 900 | 0 | −181 | A |
| 16 | 14 | 80 | 10 | 20 | 1,000 | 0 | −126 | A |
| 17 | 14 | 80 | 10 | 20 | 1,100 | 0 | −71 | A |
| 18 | 14 | 80 | 10 | 20 | 900 | −181 | −181 | B |
| 19 | 14 | 80 | 10 | 20 | 900 | −181 | −181 | A |
| 20 | 14 | 80 | 10 | 20 | 900 | −181 | −181 | A |

TABLE 4

| Test No. | $d_I$ (μm) | L (μm) | $d_p$ (μm) | $d_a$ (μm) | $V_c$ (V) | $V_b$ (V) | Z* | Noise |
|---|---|---|---|---|---|---|---|---|
| 21 | 14 | 50 | 18 | 20 | 1,400 | 0 | −141 | A |
| 22 | 14 | 50 | 18 | 20 | 1,600 | 0 | −80 | A |
| 23 | 14 | 50 | 18 | 20 | 1,800 | 0 | −19 | A |
| 24 | 14 | 50 | 18 | 20 | 2,000 | 0 | 42 | B |
| 25 | 14 | 50 | 18 | 20 | 2,200 | 0 | 103 | B |
| 26 | 14 | 50 | 18 | 30 | 1,800 | 0 | −100 | A |
| 27 | 14 | 50 | 18 | 10 | 1,800 | 0 | 62 | B |

TABLE 4-continued

| Test No. | $d_I$ (μm) | L (μm) | $d_p$ (μm) | $d_a$ (μm) | $V_c$ (V) | $V_b$ (V) | Z* | Noise |
|---|---|---|---|---|---|---|---|---|
| 28 | 14 | 50 | 18 | 20 | 1,600 | −200 | −80 | B |
| 29 | 14 | 50 | 18 | 20 | 1,800 | −200 | −19 | C |
| 30 | 14 | 50 | 18 | 20 | 1,600 | −100 | −80 | B |
| 31 | 14 | 50 | 18 | 20 | 1,800 | −100 | −19 | B |
| 32 | 14 | 50 | 18 | 20 | 1,600 | 100 | −80 | A |
| 33 | 14 | 50 | 18 | 20 | 1,800 | 100 | −19 | A |
| 34 | 14 | 50 | 18 | 20 | 2,000 | 100 | 42 | A |
| 35 | 14 | 50 | 20 | 20 | 900 | 0 | −181 | A |
| 36 | 14 | 50 | 20 | 20 | 1,000 | 0 | −126 | A |
| 37 | 14 | 50 | 20 | 20 | 1,100 | 0 | −71 | A |
| 38 | 14 | 50 | 20 | 20 | 900 | −200 | −181 | B |
| 39 | 14 | 50 | 20 | 20 | 900 | −100 | −181 | A |
| 40 | 14 | 50 | 20 | 20 | 900 | 100 | −181 | A |

TABLE 5

| Test No. | $d_I$ (μm) | L (μm) | $d_p$ (μm) | $d_a$ (μm) | $V_c$ (V) | $V_b$ (V) | Z* | Noise |
|---|---|---|---|---|---|---|---|---|
| 41 | 18 | 80 | 18 | 20 | 1,400 | 0 | −141 | A |
| 42 | 18 | 80 | 18 | 20 | 1,600 | 0 | −80 | A |
| 43 | 18 | 80 | 18 | 20 | 1,800 | 0 | −19 | A |
| 44 | 18 | 80 | 18 | 20 | 2,000 | 0 | 42 | B |
| 45 | 18 | 80 | 18 | 20 | 2,200 | 0 | 103 | B |
| 46 | 18 | 80 | 18 | 20 | 1,600 | −200 | −80 | B |
| 47 | 18 | 80 | 18 | 20 | 1,800 | −200 | −19 | B |
| 48 | 18 | 80 | 18 | 20 | 1,600 | −100 | −80 | B |
| 49 | 18 | 80 | 18 | 20 | 1,800 | −100 | −19 | B |
| 50 | 18 | 80 | 18 | 20 | 1,600 | 100 | −80 | A |
| 51 | 18 | 80 | 18 | 20 | 1,800 | 100 | −19 | A |
| 52 | 18 | 80 | 18 | 20 | 2,000 | 100 | 42 | A |

As can be seen from the above tables 3 to 5, where $V_b > Z^*$, i.e., equation (18) is satisfied, the image free from discharge noise can be obtained.

Although the present invention has been fully described by way of examples with reference to the accompanying drawings, it is to be noted that various changes and modifications will be apparent to those skills in the art. Therefore, unless otherwise such changes and modifications depart from the scope of the present invention, they should be construed as being included therein.

What is claimed is:

1. An image forming apparatus, comprising:

a first conductive member;

a photoelectric transfer layer mounted on said first conductive member, said photoelectric transfer layer having a thickness Dp (μm);

a surface electrode mounted adjacent to said photoelectric transfer layer but away from said first conductive layer;

a dielectric layer opposed to said surface electrode, said dielectric layer being spaced away from said photoelectric transfer layer with leaving a space gap $D_a$ (μm) therebetween;

a second conductive member mounted on one surface of said dielectric layer away from said photoelectric transfer layer;

a first power supply applying a voltage $V_c$ between said first and second conductive members; and a second power supply applying a voltage $V_b$ between said surface electrode and said second conductive member;

wherein said $D_p$, $D_a$, $V_0$ and $V_b$ have a following relationship:

$$V_b > (5.5)V_c - (1+5.5/D_p)(312+6.2D_a)$$

said image forming apparatus further comprising an exposing device, said exposing device exposes said photoelectric transfer layer, generating an electric discharge between said photoelectric transfer layer and said dielectric layer, which results in an electrostatic latent image on said dielectric layer.

2. An image forming apparatus claimed in claim 1, further comprising a drive device which moves said dielectric layer relative to said photoelectric transfer layer.

3. An image forming apparatus claimed in claim 1, further comprising a visual-image forming device which visualizes said electrostatic latent image by the use of toner including thermoplastic resin.

4. An image forming apparatus claimed in claim 1, further comprising a fusing device which heats said toner on said dielectric layer, transferring said heated toner onto a recording medium.

5. An image forming apparatus claimed in claim 1, wherein said surface electrode is provided in a certain pattern.

6. An image forming apparatus claimed in claim 1, said thickness $D_p$ of said photoelectric transfer layer satisfies a following relationship:

$$5\ \mu m \leqq D_p \leqq 20\ \mu m.$$

7. An image forming apparatus claimed in claim 1, said space gap $D_a$ between said dielectric layer and said photoelectric transfer layer satisfies a following relationship:

$$5\ \mu m \leqq D_a \leqq 100\ \mu m.$$

8. An image forming apparatus claimed in claim 1, an absolute voltage value of $V_c$ satisfies a following relationship:

$$500\ \text{volts} \leqq V_c \leqq 3000\ \text{volts}.$$

9. An image forming apparatus claimed in claim 1, an absolute voltage value of said voltage $V_b$ satisfies a following relationship:

$$0\ \text{volts} \leqq Vb \leqq 500\ \text{volts}.$$

10. An image forming apparatus, comprising:

a first conductive member;

a photoelectric transfer layer mounted on said first conductive member, said photoelectric transfer layer having a thickness $D_p$ (μm);

a surface electrode mounted adjacent to said photoelectric transfer layer but away from said first conductive layer, said surface electrode including a slot having a width L (μm);

a dielectric layer, having a thickness $D_i$ (μm) and a dielectric constant $\epsilon_i$, opposed to said surface electrode, said dielectric layer being spaced away from said photoelectric transfer layer with leaving a space gap $D_a$ (μm) therebetween;

a second conductive member mounted on one surface of said dielectric layer away from said photoelectric transfer layer;

a first power supply applying a voltage $V_c$ (volts) between said first and second conductive members; and a second power supply applying a voltage $V_b$ (volts) between said surface electrode and said second conductive member;

wherein said L, $D_p$, $D_a$, $D_i$, $\epsilon_i$, $V_c$ and $V_b$ have following relationships:

$$L<2D_a+2D_i(D_a+50)(\epsilon_i D_a)-V_b/3.1 \quad V_c-V_b>3.1L+7.5D_p+312$$

said image forming apparatus further comprising an exposing device, said exposing device exposes said photoelectric transfer layer, generating an electric discharge between said photoelectric transfer layer and said dielectric layer, which results in an electrostatic latent image on said dielectric layer.

11. An image forming apparatus claimed in claim 10, further comprising a drive device which moves said dielectric layer relative to said photoelectric transfer layer.

12. An image forming apparatus claimed in claim 10, further comprising a visual-image forming device which visualizes said electrostatic latent image by the use of toner including thermoplastic resin.

13. An image forming apparatus claimed in claim 10, further comprising a fusing device which heats said toner on said dielectric layer, transferring said heated toner onto a recording medium.

14. An image forming apparatus claimed in claim 10, said thickness $D_p$ of said photoelectric transfer layer satisfies a following relationship:

$$5\ \mu m \leqq D_p \leqq 20\ \mu m.$$

15. An image forming apparatus claimed in claim 10, said space gap $D_a$ between said dielectric layer and said photoelectric transfer layer satisfies a following relationship:

$$5\ \mu m \leqq D_a \leqq 100\ \mu m.$$

16. An image forming apparatus claimed in claim 10, an absolute voltage value $V_c$ satisfies a following relationship:

$$500\ \text{volts} \leqq V_c \leqq 3000\ \text{volts}.$$

17. An image forming apparatus claimed in claim 10, an absolute voltage value of said voltage $V_b$ satisfies a following relationship:

$$0\ \text{volts} \leqq Vb < 500\ \text{volts}.$$

18. An image forming apparatus, comprising:

a first conductive member;

a photoelectric transfer layer mounted on said first conductive member, said photoelectric transfer layer having a thickness $D_p$ ($\mu$m);

a surface electrode mounted adjacent to said photoelectric transfer layer but away from said first conductive layer, said surface electrode having a small conductive portion having a width W of 20 $\mu$m or less;

a dielectric layer opposed to said surface electrode, said dielectric layer being spaced away from said photoelectric transfer layer;

a second conductive member mounted on one surface of said dielectric layer away from said photoelectric transfer layer;

a first power supply applying a voltage between said first and second conductive members;

a second power supply applying a voltage between said surface electrode and said second conductive member; and an exposing device, said exposing device exposes said photoelectric transfer layer, generating an electric discharge between said photoelectric transfer layer and said dielectric layer, which results in an electrostatic latent image on said dielectric layer.

19. An image forming apparatus claimed in claim 18, wherein a length L ($\mu$m) of said small-conductive portion of said surface electrode and said width W ($\mu$m) satisfy following relationships:

$$2\ \mu m \leqq W \leqq 20\ \mu m,$$

$$15\ \mu m \leqq L \leqq 150\ \mu m.$$

20. An image forming apparatus claimed in claim 19, further comprising a drive device which moves said dielectric layer relative to said photoelectric transfer layer.

21. An image forming apparatus claimed in claim 19, further comprising a visual-image forming device which visualizes said electrostatic latent image by the use of toner including thermoplastic resin.

22. An image forming apparatus claimed in claim 19, further comprising a fusing device which heats said toner on said dielectric layer, transferring said heated toner onto a recording medium.

* * * * *

UNITED STATES PATENT AND TRADEMARK OFFICE

CERTIFICATE OF CORRECTION

PATENT NO. : 5,930,565

DATED : July 27, 1999

INVENTOR(S) : Isao DOI, et al.

It is certified that error appears in the above-identified patent and that said Letter Patent is hereby corrected as shown below:

In the Claims:

Column 15, Claim 1, Line 65, change "$V_o$" to --$V_c$--.

Column 17, Claim 17, Line 49, change "0 volts $\leqq$ Vb < 500 volts" to

–0 volts $\leqq$ Vb $\leqq$ 500 volts--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*